United States Patent [19]

Keller

[11] 3,986,295

[45] Oct. 19, 1976

[54] TELESCOPING ARM FOR TOY FIGURE

[75] Inventor: David Edward Keller, Hacienda Heights, Calif.

[73] Assignee: Mattel, Inc., Hawthorne, Calif.

[22] Filed: Jan. 14, 1976

[21] Appl. No.: 649,125

[52] U.S. Cl. ..... 46/119; 46/142

[51] Int. Cl.[2] ..... A63H 13/06

[58] Field of Search ..... 46/116, 119, 142, 145, 46/143, 148

[56] References Cited

UNITED STATES PATENTS

| | | | |
|---|---|---|---|
| 3,377,740 | 4/1968 | Bonnano et al. | 46/119 |
| 3,425,153 | 2/1969 | Bonnano et al. | 46/119 |
| 3,452,472 | 7/1969 | Meyer et al. | 46/119 |
| 3,856,304 | 12/1974 | Matsumoto et al. | 46/142 |

*Primary Examiner*—Louis G. Mancene

*Assistant Examiner*—Robert F. Cutting

*Attorney, Agent, or Firm*—Stephen King; Robert W. Mulcahy; Max E. Shirk

[57] ABSTRACT

A figurine is disclosed having an arm rotatably mounted to a torso; a hand carried on a shaft, which shaft is received within the hollow of the arm; means located within the hollow of the arm for latching said shaft in a first position and biasing means located within the hollow of said arm for urging sad shaft forward out of said hollow arm; and means responsive to manual actuation of a torso portion for unlatching said shaft to cause said hand to extend to a position remote from the end of said arm. A gauntlet of a sleevelike nature surrounds the arm and is coupled at an end to the hand so as to obstruct visibility of said shaft when said hand is in the extended position to thereby simulate an increase in length of said arm. Specific novel structure in the provided means is also disclosed.

11 Claims, 3 Drawing Figures

TELESCOPING ARM FOR TOY FIGURE

FIELD OF THE INVENTION

This invention relates to animated toys and, more particularly, to toy figurines having movable parts.

BACKGROUND OF THE INVENTION

Various toy figurines exist in the prior art of the type having animated portions to interest and amuse children. One such type of toy is the figurine illustrated in U.S. Pat. No. 3,699,713, issued Oct. 24, 1972, and assigned to the same assignee as the present invention. In that prior patent, the animated toy figurine is disclosed in which a mechanical button accessible at the back of the torso of the figurine is depressed to raise an arm. Toys of similar nature found in the prior art and made known to me having movable parts include U.S. Pat. Nos. 2,990,643, 3,495,826, 2,623,329, and 2,968,122, to which the reader may make reference by way of background. In particular, the U.S. Pat. No. 2,623,329 illustrates a figurine having telescoping appendages, and U.S. Pat. No. 2,990,643 illustrates a toy bank with a "pop-up" head.

OBJECTS OF THE INVENTION

The present invention, by way of improvement to the prior art and, as my objective, the improvement upon the toy figurine illustrated in U.S. Pat. No. 3,699,713, is to provide a toy figurine and an arm assembly in which the arm appears to telescope out and "throw a punch".

It is a further object of my invention to provide an arm assembly capable of projecting a clenched fist that is of relatively simple and easily assembled structure.

It is an additional object of my invention to provide a toy figurine having an arm that may be rotated to various positions in any of which the hand may be projected forward or outward to throw a punch by depression of a mechanical switch actuated at the back of the torso of the figurine.

Briefly, the invention in a toy figurine includes a simulated arm of hollow construction having a shoulder end and a front end with an aperture therein; a shaft reciprocally mounted within said arm and extending out the aperture and coupled to a simulated clenched fist; bias means located within the hollow of said arm for urging said shaft out of said arm and means are included within said arm for latching said shaft in the retracted position. In an additional aspect a ring or cuff member surrounds the clenched fist and this in turn supports a frusto-conical shaped sleeve or gauntlet that extends from the fist over a substantial portion of the arm. Means such as means associated with the torso of the toy figurine may be used to unlatch the shaft whereupon the shaft moves forwardly to project the fist and gauntlet forward while the gauntlet obstructs the view of the shaft. In other aspects of the invention a novel coupling is shown for rotatably attaching the arm to the torso and allowing said fist to be unlatched and latched regardless of the rotational position of the arm.

The foregoing objects and advantages of my invention, together with the structure characteristic thereof, and other advantages and equivalents thereto, become more apparent and are better understood by giving consideration to the detailed description of the embodiment of the invention which follows taken together with the figures of the drawings.

DETAILED DESCRIPTION

Figure 1:
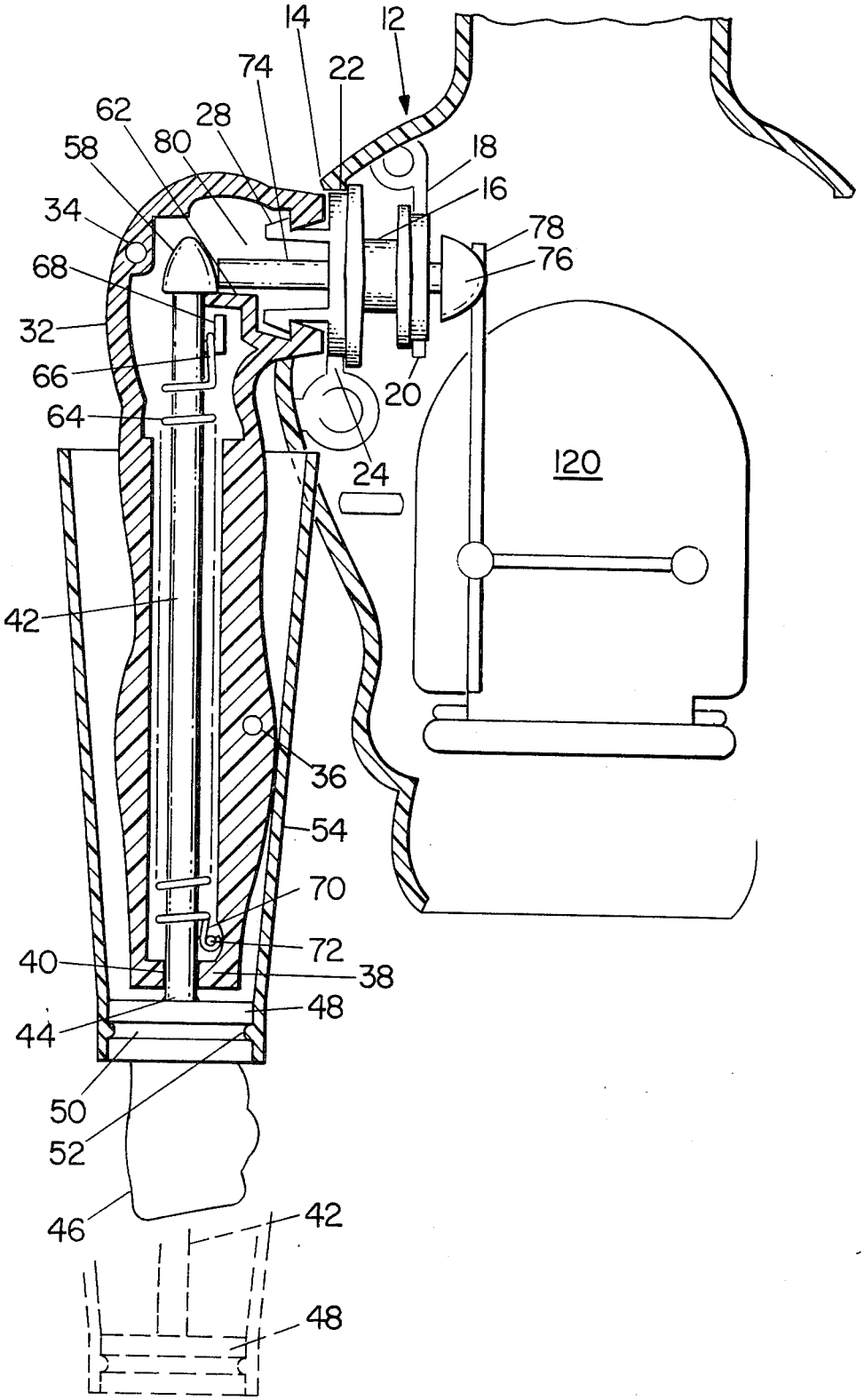
FIG. 1 illustrates in cross-section the elements of the preferred embodiment.

As is shown in the sectional view of FIG. 1, the arm 32 has a hollow inside and contains an opening at its shoulder end and a second opening 40 at a closed free or hand end 38. A shaft 42 is provided which extends from beyond the closed free end 38 as at 44 and has coupled thereto a simulated fist 46 containing a grooved 52 cuff or ring 50. The shoulder end of the shaft includes a head or dome-shaped portion 58 with a base of greater diameter or cross-sectional area than the shaft 42 so as to form an annulus or shoulder 60. A clip 68 is integrally formed on the shaft near the shoulder end thereof and a pin 72 is formed at the hand end of arm 32 integrally with the arm. A helical spring 64 is mounted about shaft 42. The spring has one end inserted and retained in clip 68 and has its other end thereof attached to pin 72. In the retracted position of shaft 42, illustrated, the spring is stretched and exerts a mechanical biasing force urging said shaft to move axially to an extended position in which a substantial portion of the shaft travels outside the arm. A ledge 62 is integrally formed within the shoulder portion of arm 32. The ledge engages shoulder 60 of the shaft dome portion 58 so as to latch the shaft in the position illustrated. A gauntlet or sleeve 54 is of a frusto-conical shape and extends a substantial length of the arm, as illustrated, but is greater in length than the length to which shaft 42 protrudes from free end 38 of the arm in the extended position, as is indicated in dash lines. At its narrower end the gauntlet is coupled to the cuff 52 suitably by one or more protruding lip portions 52 that engage the groove 50. The other portion of the arm, not illustrated, may be joined conventionally through use of pins 36 and 34 and/or suitable adhesive.

Except for the spring 64, all of the aforedescribed parts and those hereafter described are suitably made of a plastic or polymer material with the term "plastic" being presented in the conventional term understood by the layman.

At the shoulder end of arm 32 an inturned flange portion 30 is formed which is used to assist the coupling of the arm to the torso partially illustrated in section 12. In the torso a series of webs 18, 20, 22 and 24 support a journal member 16, which member is freely rotatable. the journal member has a hollow center and a series of hooklike fingers 28. The hooklike fingers engage the external annular flange of the arm on the surface thereof inside the hollow of the arm to hold the arm to the torso. A pin 74 is slidably mounted within the pin journal 16, extends from the torso into the arm, and is sufficient in length to extend at least to the end of ledge 62 for reasons which hereinafter become more apparent. Pin 74 includes a dome-shaped head 76 as shown located in the torso portion.

The ramp or wedge member 78 is included in the torso. Member 78 is mounted so that by pivoting it comes into contact with head 76, as hereafter more fully explained. This actuator member 78 is illustrated in greater detail in FIG. 2.

By way of background, reference is made to U.S. Pat. No. 3,699,713, granted Oct. 24, 1972, and assigned to the assignee of the present application, which patent disclosure is referred to an incorporated therein. The lever mechanism is arranged within the body in the same manner as element 120 in FIG. 1 and FIG. 2 and FIG. 4 of the cited patent, but with the rack 116 removed and replaced by the ramp 78 and with the gear 118 removed and replaced by pin 74. Additionally, elements 104 and 106 in the prior patented stucture illustrated in the patent is replaced by the journal member 16.

Figure 2:
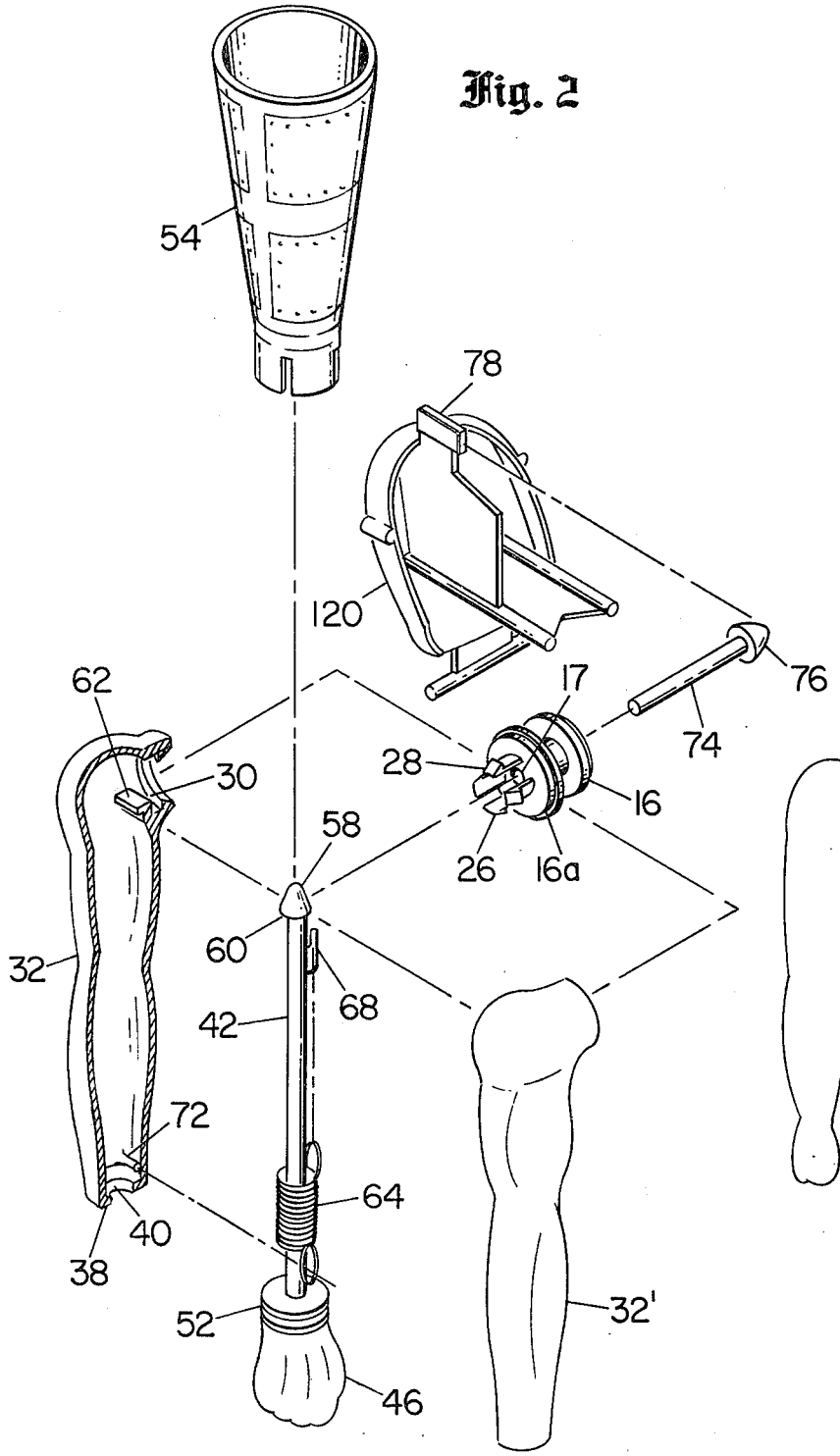
FIG. 2 represents the elements of the embodiment in an exploded view.

Reference is now made to FIG. 2 which depicts the aforedescribed elements in an exploded view. Where the parts have neen illustrated and described in connection with FIG. 1 it is desired to use the same reference numerals to describe those same elements in this FIG. 2. Thus, FIG. 2 shows the arm 32 and the opposite arm part or half 32'. The arm 32 includes the closed free end 38 with the aperture 40 and the pin 72 integrally formed within the hollow of arm 32 and located proximate end 38. the inturned annular flange 30 is illustrated at the shoulder end of arm 32 surrounding the opening at the shoulder end of arm 32, and the ledge 62 which forms a part of the shaft latching mechanism is more clearly illustrated in this figure. The shaft 42 includes the clenched fist 46 at one end as well as the cuff 52 and the integrally formed clip member 68 for retaining a spring end at the other end of the shaft proximate the bulbous shaft end head 58. As is apparent, the shoulder portion 60 of the head 58 is not visible in this figure. The spring 64 is illustrated in its relaxed condition. The dotted lines indicate the placement of the first and second ends of spring 64 on clip 68 and pin 72. The gauntlet is as illustrated at 54. Journal member 16 is seen to have the four resilient hooklike finger members including the two previously illustrated finger 28 and finger 26. As is apparent, when the shoulder is pushed toward the torso during assembly the fingers move radially inwardly as flange 30 presses against the ramplike surfaces of the fingers until the flange 30 passes over the hooklike ends of the fingers. The fingers then spring out and retain the shoulder in place by an abutment with the hooklike end of the fingers and the inner flange portion 30.

The journal includes the cylindrical bearing surface 16a and, as was illustrated in FIG. 1, the surface 16a is fitted within a web which similarly forms a cylindrical surface so that the journal with the attached arm may be rotated. The passage 17 through the center of the journal 16 is illustrated. Pin 74 with head 76 is shown, and ramp member 78 comprising part of the mechanical backplate switch 120 is similarly illustrated. From the foregoing description the manner of assembly of the elements becomes self-evident.

Figure 3:
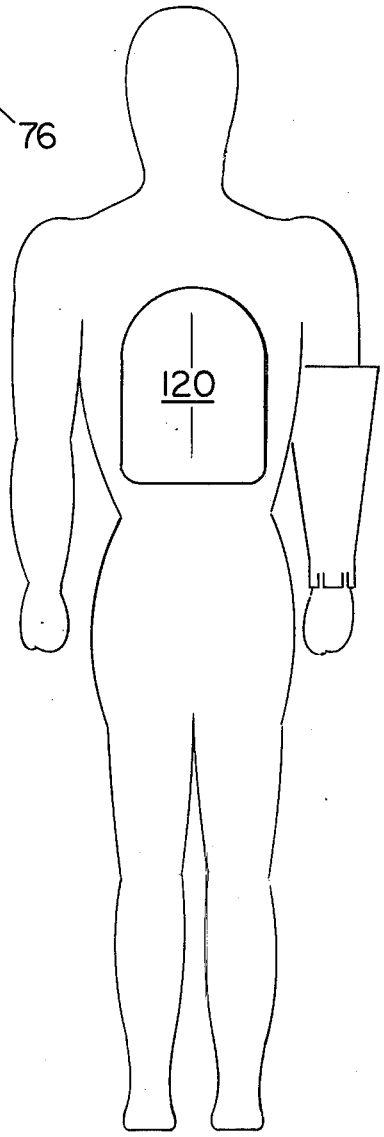
FIG. 3 illustrates a rear perspective view to reduced scale of the toy figurine claiming the invention.

As is shown in the rearward outline figurine view of FIG. 3, drawn to reduced scale, the outline of the mechanical push member 120 which supports ramp 78 is shown in perspective.

Thus in operation the arm 32 may be rotated to various angular positions about the torso to raise or lower the arm. The arm in this respect causes the journal 16 to rotate or if the journal is held fixed the arm will simply rotate by overcoming the frictional resistance between the portions of fingers 26, 28 and the other two fingers, not shown, and the surface of the inturned annular flange 30 forming part of the arm. Assuming that the shaft is in the retracted and latched position as illustrated in FIG. 1, it is seen that the clenched fist 46 is located at the free end 38 of the arm. Assuming the user of the toy depresses the back switch member 120, illustrated in FIG. 3, the member pivots, moving ramp 78 into abutment with dome-shaped pinhead 76 and pushes on same. Pin 74 slides into engagement with dome-shaped member 58 on shaft 42. Pin 74 is sufficient in length and the travel of pin 74 is sufficient to move to the edge of ledge 62 to thereby push head 58 off the ledge, partially deflecting the shaft 42 from the position illustraded, thus unlatching the shaft. Once the shaft is thus unlatched, the force exerted by the stretched spring 64 pulls the shaft from the clip end forward and projects the shaft forward a predetermined length out of the free end of the arm. Correspondingly the clenched fist 46 and the gauntlet are projected out to the extended position with the clenched fist located remote from the free end 38 of the arm and the toy has in effect thrown a punch. By dotted lines in FIG. 1 the ultimate position of the clenched fist and gauntlet are illustrated. As is apparent, the length of the gauntlet 54 is sufficient to at least extend back to the free end of arm 32 so as to obstruct a view of the shaft. It thus appears to the user that the arm length 32 has increased in length. To restore the arm to its retracted and latched position the user simply pushes on the clenched fist 46 to force the shaft back into its position within the hollow arm. In so doing the user stretches the spring. As the domelike head 58 comes in contact with ledge 62 it is apparent that the head exerts a camlike function and while moving forward deflects the shaft 42 from its axis until the head has passed the ledge. Subsequently, due to inherent resiliency in the shaft, the shaft springs back to its normal position with ledge 60 in abutment with shoulder 60. Additionally, if the pin 76 is in an extended position, head 58 similarly forces pin 74 to slide back and the shaft and hand are returned to the normal position awaiting a repeat operation through actuation of the switch member 120 and lever 78.

The aperture at the free end is sufficient to allow the shaft to clear but not large enough to allow the clip 68 or the head 58 to pass through, to thus inhibit the shaft from extending fully out of the arm.

It is believed that the foregoing description of the preferred embodiment of my invention is sufficient in detail to enable one skilled in the art to make and use same. However, it is not intended that the invention is limited to those details presented for the foregoing purpose, inasmuch as many other substitute elements or equivalents, as well as improvements, become apparent to one skilled in the art upon reading this specification. Thus it is expressly understood that my invention is to be broadly construed within the full spirit and scope of the appended claims.

What is claimed is:

1. A telescoping arm assembly adapted for use as an arm of a toy figurine, comprising:

a simulated human arm having a hand end and a shoulder end and an internal hollow region between said ends;

an elongated shaft, said shaft extending within the hollow of said arm through a small opening at said hand end, said shaft being reciprocally movable between a retracted position substantially within and an extended position substantially without said hollow of said arm;

a simulated human hand attached to one end of and carried by said shaft external of said simulated arm;

a sleevelike gauntlet fitted over said arm extending over a substantial portion of the length of said arm to said hand and movable with said hand for obstructing a view of said shaft when said shaft is in said extended position;

biasing means located within said hollow of said arm for mechanically urging said shaft for movement to said extended position; and releasible latching means located with said hollow of said arm for latching said shaft into said retracted position, said latching means being accessible through an opening at said shoulder end in said arm;

whereby when said shaft is released by said latching means said biasing means moves said shaft through the hollow of said arm a predetermined distance to thereby carry said hand to an extended position a predetermined distance beyond said hand end.

2. The invention as defined in claim 1 further comprising:

means coupling said gauntlet for movement with said hand including a cuff member surrounding a rear portion of said hand and containing a peripheral groove and an inwardly protruding lip portion at said one end of said sleevelike gauntlet portion engaging said groove.

3. The invention as defined in claim 1 wherein said biasing means comprises a helical spring, means for coupling one end of said spring means to said arm at a location therewithin proximate said hand end; and means for coupling the other end of said spring means to said shaft at a location on said shaft remote from said hand carrying end.

4. The invention as defined in claim 1 wherrein said means for latching said shaft comprises:

a dome-shaped member coupled at its base end to an end of said shaft, said dome-shaped member base having a base larger in cross-sectional area than said shaft to form a flat annular shoulder;

a ledge located within the hollow of said arm adjacent said shoulder end and in the path of movement of said dome-shaped member for engaging the shoulder portion of said shaft end;

and whrerin said shaft is laterally deflectable;

whereby said shoulder portion may be pushed off said ledge deflecting said shaft and said biasing means moves said shaft to said extended position.

5. The invention as defined in claim 4 further comprising, in combination:

a torso portion of a figurine, torso coupling means coupling said telescoping arm at said shoulder portion to said torso portion, said coupling means permitting rotatable movement of said arm relative to said torso;

elongated pin means extending through said torso coupling means from said torso portion into said shoulder end of said arm, said pin means being movable along its axis into the path of said dome-shaped member, when said shaft is in said latched position, for deflecting said shaft and moving said member off said ledge; and means responsive to finger pressure on the back portion of said torso for axially moving said pin.

6. The invention as defined in claim 5 wherein said opening at said shoulder end in said arm includes:

an inwardly directed annular flange;

and wherein said torso coupling means includes: a journal member having at least two cylindrical surfaces held within said torso portion, a pin receiving passage extending axially therethrough and opening into said shoulder opening, and a plurality of resilient fingers extending from said journal member into said shoulder for engagement with the surface of said annular shoulder flange located within the hollow of said arm for holding said arm to said torso.

7. Apparatus for animating an appendage on a toy figurine comprising:

a simulated human limb having a first and second end and an internal hollow region between said ends;

an elongated shaft, said shaft extending within the hollow of said limb through a small opening at said first end and said shaft being reciprocally movable between a retractable position substantially within said limb and an extended position substantially without said hollow of said limb;

biasing means located within said hollow of said limb for mechanically urging said shaft for movement to said extended position;

releasible latching means located within said hollow of said limb for latching said shaft into said retracted position, said latching means being accessible through an opening at said second end in said limb;

a torso portion of a figurine;

torso coupling means for coupling said limb to said torso portion at said second end, and means responsive to externally applied pressure on the back portion of said torso for releasing said latching means;

whereby said biasing means moves said shaft through the hollow of said limb a predetermined distance.

8. A telescoping arm assembly adapted for use as an arm of a toy figurine, comprising:

a simulated human arm having a hand end and a shoulder end and an internal hollow region between said ends;

an elongated shaft, said shaft extending within the hollow of said arm through a small opening at said hand end, said shaft being reciprocally movable between a retracted position substantially within and an extended position substantially without said hollow of said arm;

a simulated human hand attached to one end of and carried by said shaft external of said simulated arm;

biasing means located within said hollow of said arm for mechanically urging said shaft for movement to said extended position, and releasible latching means located with said hollow of said arm for latching said shaft into said retracted position, said latching means being accessible through an opening at said shoulder end in said arm;

whereby when said shaft is released by said latching means said biasing means moves said shaft through the hollow of said arm a predetermined distance to thereby carry said hand to an extended position a predetermined distance beyond said hand end of said arm.

9. The invention as defined in claim 8 wherein said means for latching said shaft comprises:

a dome-shaped member coupled at its base end to an end of said shaft, said dome-shaped member base having a base larger in cross-sectional area than said shaft to form a flat annular shoulder;

a ledge located within the hollow of said arm adjacent said shoulder end and in the path of movement of said dome-shaped member for engaging the shoulder portion of said shaft end;

and wherein said shaft is laterally deflectable;

whereby said shoulder portion may be pushed off said ledge deflecting said shaft and said spring means moves said shaft to said extended position.

10. The invention as defined in claim 9 further comprising, in combination:

a torso portion of a figurine, torso coupling means coupling said telescoping arm at said shoulder portion to said torso portion, said coupling means permitting rotatable movement of said arm relative to said torso;

elongated pin means extending through said torso coupling means from said torso portion into said shoulder end of said arm, said pin means being movable along its axis into the path of said dome-shaped member, when said shaft is in said latched position, for deflecting said shaft and moving said dome-shaped member off said ledge; and means responsive to pressure applied to the back portion of said torso portion for axially moving said pin.

11. In a toy figurine, the combination comprising:

a hollow torso portion;

a hollow arm having a shoulder end and a hand end;

means for mounting said arm at said shoulder end to said torso portion for rotatable movement therebetween;

an elongated shaft of a length sufficient to extend from said shoulder end to beyond said hand end of said simulated arm, said shaft having a front and back end; and a simulated hand carried by said shaft at the front end thereof;

helical spring means surrounding said shaft, said spring means having one end coupled to said arm at a location within the hollow adjacent said hand end and having its other end coupled to said shaft at a location proximate said back end of said shaft, said spring means for urging said shaft out said hand end of said simulated arm;

an enlarged dome-shaped portion at said shoulder end of said shaft forming a shoulder;

a ledge portion within said arm for engaging said shoulder portion to latch said shaft in the withdrawn position against said bias force of said spring;

pin means located within said torso portion and extending into said shoulder portion of said simulated arm for movement into engagement with said dome-shaped portion for moving said shoulder portion off said ledge and deflecting said shaft to thereby unlatch said shaft; and means within said torso portion responsive to pressure applied by the user for moving said pin means along said axis to unlatch said shaft whereby said shaft carries said hand to an extended position away from the hand end of said simulated arm.

* * * * *